United States Patent [19]

Kanbar

[11] Patent Number: 4,775,768

[45] Date of Patent: Oct. 4, 1988

[54] UNIVERSAL PIN SWITCH

[75] Inventor: Maurice S. Kanbar, New York, N.Y.

[73] Assignee: Harrison Systems Corp., Wilkes Barre, Pa.

[21] Appl. No.: 8,832

[22] Filed: Jan. 30, 1987

[51] Int. Cl.[4] ..... H01H 13/14

[52] U.S. Cl. ..... 200/340; 200/159 R; 200/61.62

[58] Field of Search ..... 200/340, 300, 61.62, 200/61.7, 61.73, 159 R, DIG. 25; 285/4

[56] References Cited

U.S. PATENT DOCUMENTS

| | | | |
|---|---|---|---|
| 1,112,760 | 10/1914 | Boosey | 285/4 |
| 3,251,971 | 5/1966 | Fraser | 200/159 R |
| 3,821,529 | 6/1974 | Kallage, Jr. et al. | 200/340 |
| 3,835,615 | 9/1974 | King, Jr. | 285/4 |

FOREIGN PATENT DOCUMENTS

| | | | |
|---|---|---|---|
| 3320455 | 5/1984 | Fed. Rep. of Germany | 200/61.62 |

*Primary Examiner*—Henry J. Recla
*Assistant Examiner*—Linda J. Sholl
*Attorney, Agent, or Firm*—Michael Ebert

[57] ABSTRACT

A pin switch which when actuated by a swingable door or other movable member breaks an electrical circuit. The switch includes a metal frame mountable on a panel and a hollow metal cylinder placed over a port in the frame and projecting from its rear. Received within the cylinder is the rear section of an insulation rod that extends through an end slot in the cylinder and terminates in a contact. The rear section is spring biased so that its contact normally engages the rear end of the cylinder which functions as the fixed contact of the switch, the switch then being closed. The front section of the rod projects forwardly from the port so that when it is pressed in by the door, the rod is axially displaced to effect disengagement of the contacts to open the switch. The front section of the rod is in a corrugated formation to define a series of equi-spaced annular grooves each marking an increment of rod length. In order to tailor the pin switch so that its effective length is appropriate to the requirements of a given installation, the user simply snips off the front section at the groove marking the desired length.

5 Claims, 2 Drawing Sheets

UNIVERSAL PIN SWITCH

BACKGROUND OF INVENTION

1. Field of Invention

This invention relates generally to pin switches which are actuatable by a swingable door or other movable member to open a normally-closed electrical circuit, and more particularly to a universal switch of this type which can be tailored in length to meet the requirements of various installations.

2. Status of Prior Art

The function of a pin switch is to break an electrical circuit when the switch comes into physical contact with a movable member at a predetermined position of this member, and to close the circuit when the member is shifted to another position. To carry out this function, the pin switch is provided with a pin or rod that when pressed in by the movable member effects disengagement of the normally-interengaged switch contacts.

Pin switches are commonly used in refrigerators and electric ovens, the switch being so installed that when the hinged door of the refrigerator or oven is swung open to provide access to the interior, the switch then closes to complete a circuit to a lamp illuminating the interior. But when the door is thereafter shut, it then presses in the actuator pin of the switch, thereby opening the switch and turning off the light so that the interior of the refrigerator or oven is no longer illuminated.

A similar pin switch arrangement is often used in closets to turn on a closet light when the closet door is opened and to switch the light off when it is shut. Pin switches are also used in conjunction with automobile security systems to set off an alarm when the trunk of the vehicle is forced open by an intruder.

In this security installation, the system is put in its active mode by the owner before he leaves the vehicle, say, at a parking site. The pin switch is so placed in relation to the hinged trunk that the switch is in an open state when the trunk is fully closed. But if the trunk is thereafter forced open while the security system is in its active mode, the resultant closure of the pin switch triggers the security system to set off the alarm.

The practical problem encountered with pin switches is that each installation requires a pin length that puts the mounted pin switch in proper operative relation to the door, the trunk, the lid or whatever other movable element is involved in the installation. If, therefore, one wishes to retrofit automobiles with a security system that requires a trunkactuated pin switch, the proper pin length depends on the trunk structure. And since this structure is not standardized for all cars and varies from model to model, the installer in order to cope with this situation must have available a large inventory of different pin switch sizes from which he can select the size appropriate to the installation being worked on.

Pin switches are commercially available in a range of pin lengths, and if the installer carries in inventory the full range of pin lengths, he will not be faced with a problem. But as is more often the case, the installer has a limited inventory of pin switches in different lengths, and may find that he lacks the particular length necessary to a given installation.

The need therefore exists for a universal pin switch which can without difficulty be tailored to assume the proper pin length to satisfy an installation requirement.

SUMMARY OF INVENTION

In view of the foregoing, the main object of this invention is to provide a universal pin switch which can be given any selected pin length in a range thereof covering the various requirements of pin switch installations.

A significant advantage of this universal pin switch is that it obviates the need for a large inventory of different pin switch sizes, for the installer need only have an adequate supply of universal pin switches, all of which are identical.

More particularly, an object of this invention is to provide an efficient and reliable pin switch whose pin can without difficulty be severed by a cutter at a marking groove along its length to reduce the length to that required by the installation.

Briefly stated, these objects are attained in a pin switch which when actuated by a swingable door or other movable member breaks an electrical circuit. The switch includes a metal frame mountable on a panel and a hollow metal cylinder placed over a port in the frame and projecting from its rear. Received within the cylinder is the rear section of an insulation rod that extends through an end slot in the cylinder and terminates in a contact. The rear section is spring biased so that its contact normally engages the rear end of the cylinder which functions as the fixed contact of the switch, the switch then being closed. The front section of the rod projects forwardly from the port so that when it is pressed in by the door, the rod is axially displaced to effect disengagement of the contacts to open the switch. The front section of the rod is in a corrugated formation to define a series of equi-spaced annular grooves each marking an increment of rod length. In order to tailor the pin switch so that its effective length is appropriate to the requirements of a given installation, the user simply snips off the front section at the groove marking the desired length.

OUTLINE OF DRAWINGS

For a better understanding of the invention as well as other objects and further features thereof, reference is made to the following detailed description to be read in conjunction with the accompanying drawings, wherein.

DESCRIPTION OF INVENTION

Figure 1:
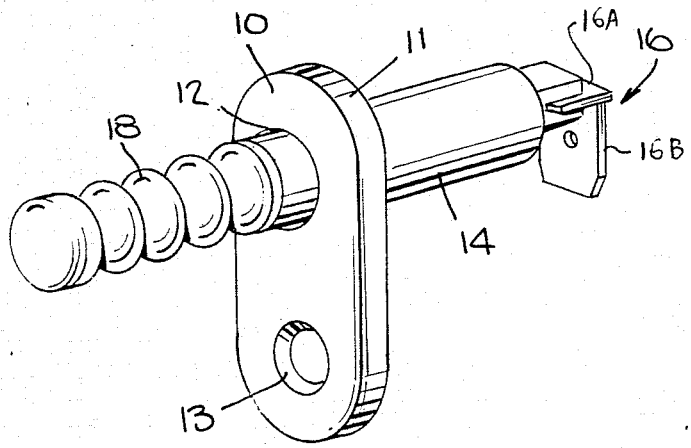
FIG. 1 is a perspective view of a pin switch in accordance with the invention.
Figure 2:
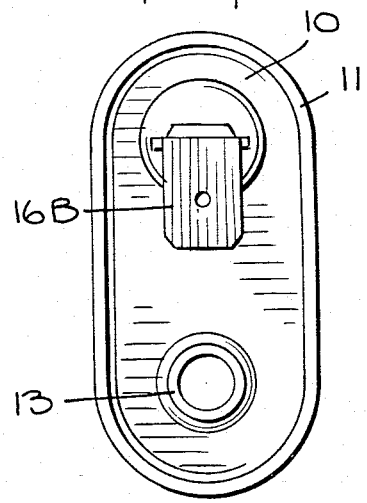
FIG. 2 is a rear view of the switch.
Figure 3:
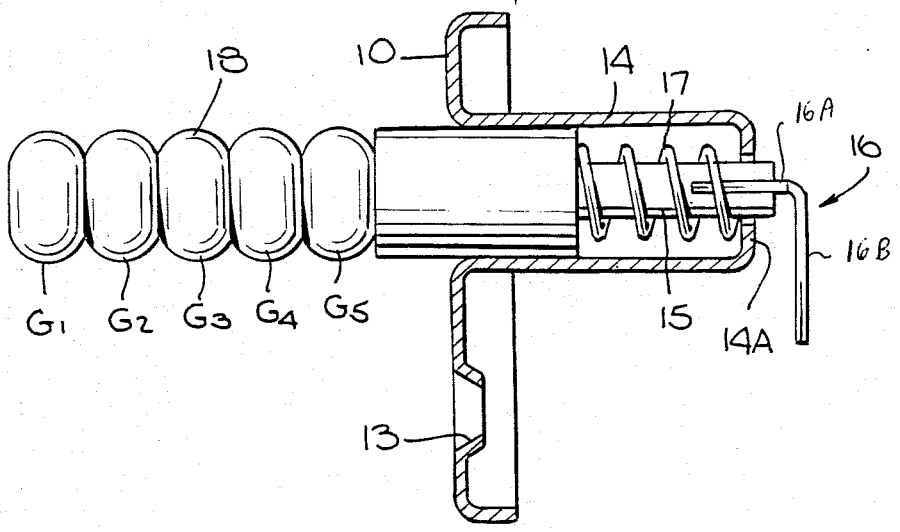
FIG. 3 is a section taken longitudinally through the switch.

Referring now to FIGS. 1, 2 and 3, there is shown a universal pin switch in accordance with the invention, the switch including a rectangular metal frame 10 having rounded corners and a peripheral flange 11. Frame 10 is provided with a circular port 12 below which is a small mounting hole 13.

Projecting from the rear of frame 10 in registration with port 12 is a hollow metal cylinder 14. Received within cylinder 14 is the rear section 15 of a solid rod of insulation material. This section has a rectangular cross section and extends through a matching slot in the rear end of the cylinder to terminate in an L-shaped metal lug 16.

One leg 16A of lug 16 is embedded in the end of rear section 15 and acts as the movable contact of the switch. The other leg 16B, which is at right angles to leg 16A, has a hole therein to receive a wire to be soldered to the leg which functions as the terminal of the movable contact.

A helical compression spring 17 is placed within cylinder 16 and surrounds rear section 15. The spring normally urges the movable contact formed by leg 16A into engagement with the dome-shaped end 14A of cylinder 14 which functions as the fixed contact of the pin switch.

The cylindrical front section 18 of the rod extends forwardly from port 12 and functions as the actuator pin of the switch. Front section 18 is in a corrugated formation, thereby defining a series of equi-spaced annular grooves $G_1$ to $G_5$, each marking an exact increment in length. In practice, the spacing between these annular grooves may be 3/16 of an inch, so that the maximum length of the corrugated portion of the front section is 15/16 of an inch.

The rod is fabricated of a rigid and somewhat brittle synthetic plastic dielectric material such as PVY or polypropylene. The physical characteristics of the rod are such that when any one of annular grooves $G_1$ to $G_5$ is engaged by a standard manual wire cutter and the cutter then operated, the front section is neatly severed at this point, so that the end of the reduced front section is smooth and flat to afford an actuating head.

Figure 4:
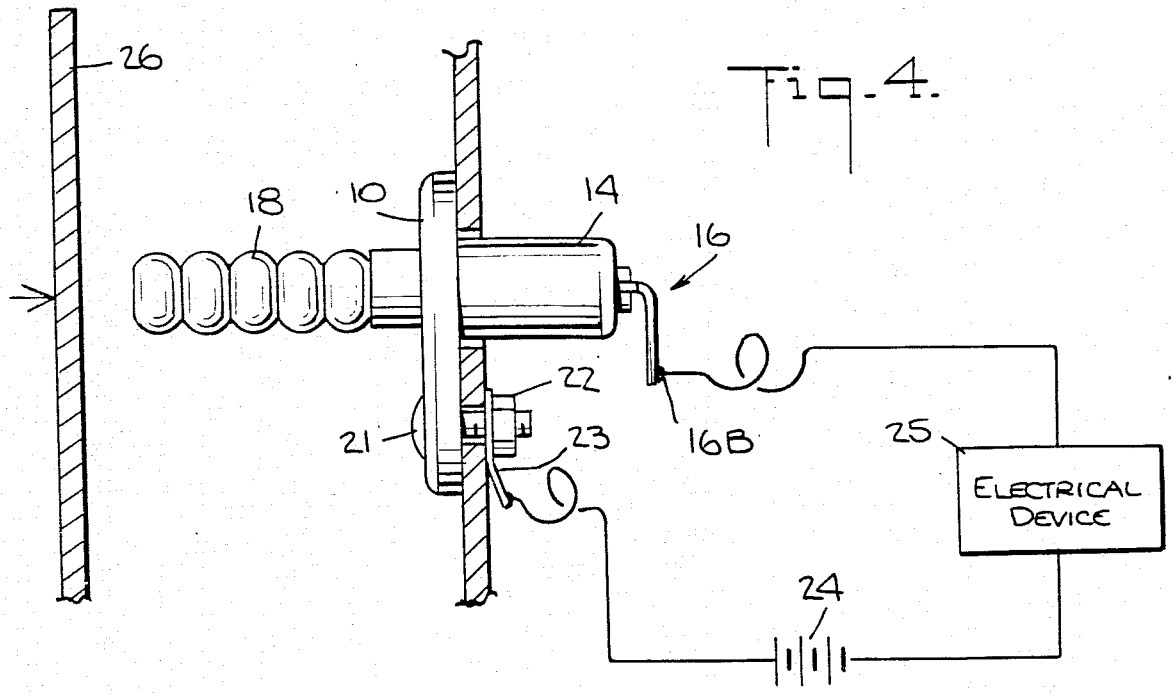
FIG. 4 shows the switch installed on a panel and connected to an electrical circuit operated thereby, the switch being shown in relation to a movable member just before actuation.

Referring now to FIG. 4, the pin switch is shown mounted on the front surface of a panel 20 having a hole therein to accommodate cylinder 14. Frame 10 of the switch is secured to the panel by a metal screw 21 which goes through mounting hole 13 therein. Secured to screw 21 by a nut 22 is a metal lug 23 which, since cylinder 14 and frame 12 are electrically conductive, acts as the connecting terminal for the fixed contact of the switch.

The pin switch is connected by wires soldered to the terminals through a power source 24, such as a battery, to an electrical device 25 which, by way of example, shall be said to be an electrical lamp. The lamp is turned on only when the switch is closed.

Figure 5:
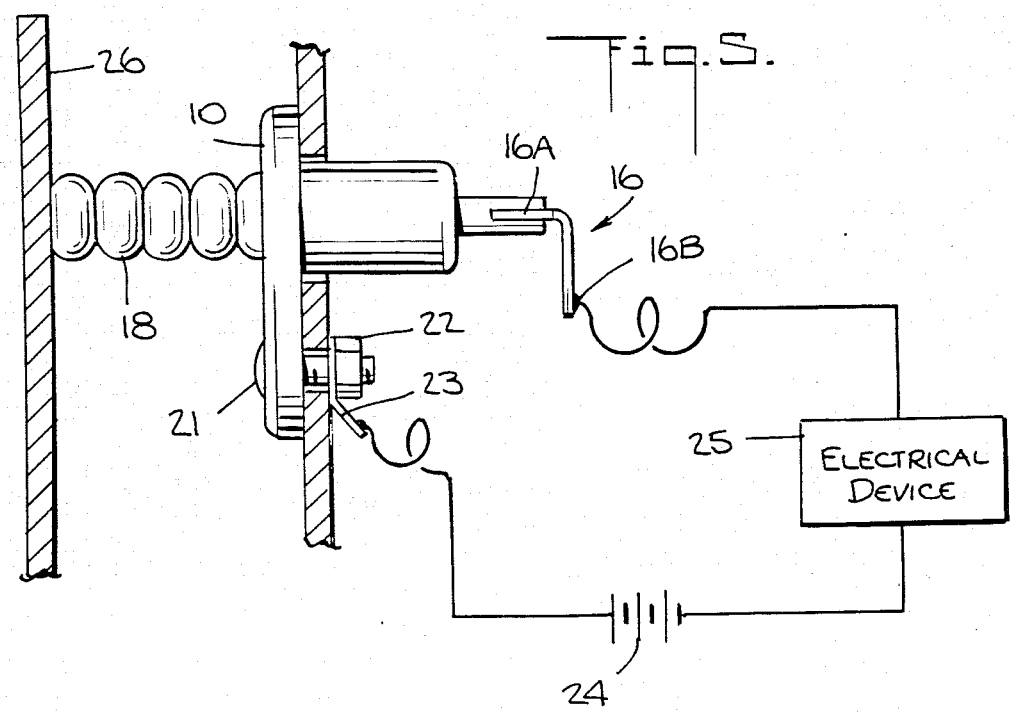
FIG. 5 shows the installed switch when actuated.

In FIG. 4, the switch is in its closed state in that the actuator pin formed by the front section 18 of the rod is out of physical contact with a movable member 26 in its proximity. But when this movable member advances to engage front section 18 and presses it in, as shown in FIG. 5, then the rear section 15 is axially shifted and movable contact 16A therein is disengaged from the fixed contact 14A formed at the end of cylinder 14. Now the switch is open and the light is turned off.

The length of front section 18 of the rod must be appropriate to the switch installation, for in some cases, the full length of section 18 is required, while in other cases a lesser length is called for. Since each annular groove $G_1$ to $G_5$ represents an increment of the full length, the installer has only to snip off a portion of the front section providing the desired lesser length. Thus, the pin switch is a universal switch in that it can be tailored to any desired length within the limits of its range.

Figure 6:
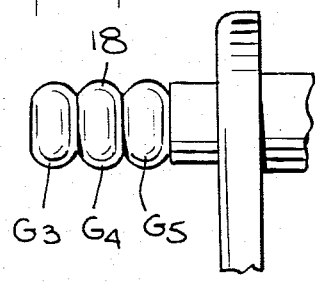
FIG. 6 illustrates the pin switch actuator rod in a reduced length.
Figure 7:
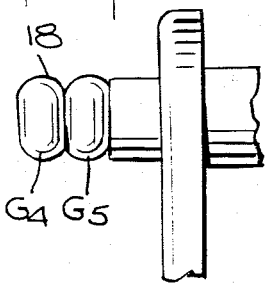
FIG. 7 illustrates the same rod in a further reduced length.

Hence if front section 18 is severed at groove $G_2$, then the reduced length is that shown in FIG. 6; but if the cut is at groove $G_3$, then the reduced length is that shown in FIG. 7.

While there has been shown and described a preferred embodiment of a universal pin switch in accordance with the invention, it will be appreciated that many changes and modifications may be made therein without, however, departing from the essential spirit thereof.

I claim:

1. A universal pin switch comprising:

A a metal frame mountable on a panel and having a port therein over which is secured a hollow metal cylinder having a predetermined diameter which is cantilevered from the rear of the frame, the rear end of the cylinder forming the fixed contact of the switch; and B a solid insulation rod formed of rigid synthetic plastic material having a rear section that is received in and extends through the rear end of the cylinder to terminate in a contact forming the movable contact of the switch, said rear section being spring-biased to normally urge said movable contact into engagement with the fixed contact to close the switch, said rod having a cylindrical front section whose diameter is substantially the same as said predetermined diameter, said front section telescoping within said cylinder and having a portion that projects forwardly from the port, the projecting portion of the front section having a corrugated formation to define a series of equi-spaced annular grooves each marking an increment of length, whereby the projecting portion of the front section can be readily severed at a selected groove to shorten it to an extent necessary to satisfy the requirements of a particular installation, said rear section having a rectangular cross section and extending through a matching slot in the rear end of the cylinder.

2. A pin switch as set forth in claim 1, wherein said movable contact is formed by an L-shaped lug, one of whose legs is embedded in the rear end of the front section, the other leg functioning as a contact terminal.

3. A pin switch as set forth in claim 1, further including a helical compression spring within said cylinder surrounding the rear section.

4. A pin switch as set forth in claim 1, wherein said front section of the rod is cylindrical in form and the corrugations form annular grooves.

5. A pin switch as set forth in claim 1, wherein said frame is rectangular and has rounded corners and a peripheral flange, said frame having a mounting hole therein below the port.

* * * * *